US007563208B1

(12) United States Patent
Chen

(10) Patent No.: US 7,563,208 B1
(45) Date of Patent: Jul. 21, 2009

(54) ADJUSTABLE KETTLEBELL

(76) Inventor: Paul Chen, 7771 Goldstream DEr., Richmond, Vancouver, BC V7A 1S5 (CA)

( * ) Notice: Subject to any disclaimer, the term of this patent is extended or adjusted under 35 U.S.C. 154(b) by 0 days.

(21) Appl. No.: 12/288,685

(22) Filed: Oct. 22, 2008

(51) Int. Cl.
*A63B 21/06* (2006.01)
*A63B 21/075* (2006.01)

(52) U.S. Cl. ..... 482/93; 482/108

(58) Field of Classification Search ..... 482/92, 482/93, 106–109, 14, 20–22, 49, 50; D21/680–682
See application file for complete search history.

(56) References Cited

U.S. PATENT DOCUMENTS

| | | | | |
|---|---|---|---|---|
| 1,917,566 | A * | 7/1933 | Wood | 482/108 |
| 6,387,022 | B1 * | 5/2002 | Smith | 482/106 |
| 7,052,445 | B2 * | 5/2006 | Ekhaus | 482/93 |
| 7,182,715 | B2 | 2/2007 | Anderson | 482/93 |
| 7,381,157 | B2 * | 6/2008 | Blateri | 482/50 |
| 7,491,157 | B1 * | 2/2009 | Lin | 482/108 |
| 2008/0081744 | A1 * | 4/2008 | Gormley | 482/93 |
| 2009/0062085 | A1 * | 3/2009 | Polevoy et al. | 482/93 |

FOREIGN PATENT DOCUMENTS

| | | | |
|---|---|---|---|
| JP | 2007021123 A | * | 2/2007 |
| WO | WO 2008057368 | * | 5/2008 |

* cited by examiner

*Primary Examiner*—Loan H Thanh
*Assistant Examiner*—Allana Lewin
(74) *Attorney, Agent, or Firm*—Charles E. Baxley

(57) ABSTRACT

An adjustable kettlebell includes a carrier having two or more compartments for selectively receiving weight members, a handle attached to the carrier for carrying the carrier, and a retaining device rotatably attached to the carrier for selectively opening the opening of the carrier and for allowing the weight members to be engaged into the carrier, and for selectively closing the opening of the carrier in order to selectively retain either or all of the weight members to the carrier. The weight members may be easily and quickly and changeably attached to the compartments of the carrier without disassembling the carrier.

10 Claims, 6 Drawing Sheets

ADJUSTABLE KETTLEBELL

BACKGROUND OF THE INVENTION

1. Field of the Invention

The present invention relates to an adjustable kettlebell, and more particularly to an adjustable kettlebell including an improved structure for allowing the weight members to be easily attached to or disengaged from the weight carrier and for allowing the adjustable kettlebell to be easily operated.

2. Description of the Prior Art

Typical kettlebells comprise a pair of oppositely-facing, generally frustum-shaped weight plates attached to a central plate with a first axis that is perpendicular to the axis of its handle, and the frustum-shaped weight plates may reduce the force of impact against the user's forearm during certain exercise movements.

For example, U.S. Pat. No. 7,182,715 to Anderson discloses one of the typical kettlebells comprising a handle attached to a central plate and including places which can be held between the user's thumb and remaining fingers for improved control during other exercise movements.

However, the weight plates may not be easily adjusted and/or changeably attached to the central plate such that the weight of the typical kettlebell may not be changed or adjusted.

U.S. Patent Application Publication No. 2008/0081744 A1 to Gormley discloses another typical adjustable kettlebell comprising a series of plates in stacked relationship, a handle having a shaft passing through the weight plates and a retaining arrangement including a base engageable with the shaft for holding and securing the weight plates together between the handle and the retaining arrangement.

However, the retaining arrangement and the base are secured together with a threaded fastening screw, and it takes time to thread and to unthread the base from the retaining arrangement such that the weight plates may not be quickly and easily attached to or disengaged from the base and the retaining arrangement and such that the typical adjustable kettlebell may not be easily operated by the users.

The present invention has arisen to mitigate and/or obviate the afore-described disadvantages of the conventional adjustable kettlebells.

SUMMARY OF THE INVENTION

The primary objective of the present invention is to provide an adjustable kettlebell including an improved structure for allowing the weight members to be easily attached to or disengaged from the weight carrier and for allowing the adjustable kettlebell to be easily operated.

In accordance with one aspect of the invention, there is provided an adjustable kettlebell comprising a carrier including a chamber formed therein, and including an opening formed in the carrier and communicating with the chamber of the carrier, and including a first compartment and at least one second compartment formed in the carrier and communicating with the chamber of the carrier, a handle attached to the carrier for carrying the carrier, a first weight member and at least one second weight member selectively engaged into the first and the second compartment of the carrier from the opening of the carrier, and a retaining device rotatably attached to the carrier for selectively opening the opening of the carrier and for allowing the first and the second weight members to be selectively engaged into the carrier, and for selectively closing the opening of the carrier in order to selectively retain either or both of the first and the second weight members to the carrier.

The carrier includes a base plate, an upper plate, and a side coupler coupled between the base plate and the upper plate for forming the opening of the carrier.

The first and the second weight members each include at least one notch formed therein for engaging with the side coupler of the carrier and for anchoring the first and the second weight members to the carrier and for preventing the first and the second weight members from rotating and moving relative to the carrier.

The carrier includes a shaft disposed between the base plate and the upper plate, and at least one supporting member attached to the shaft for forming the first and the second compartment in the carrier.

The carrier includes at least one spacer attached to the shaft and engaged with the supporting member. The first and the second weight members each include a slot formed therein for receiving the shaft.

The retaining device includes a retainer rotatably attached to the carrier for selectively opening or closing the opening of the carrier. The retaining device includes at least one panel rotatably attached to the shaft of the carrier, and the retainer is secured to the panel.

The carrier includes a spring-biased projection engaged therein for engaging with the retaining device and for anchoring the retaining device to the carrier at a required position. The retaining device includes at least one depression formed therein for engaging with the spring-biased projection.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
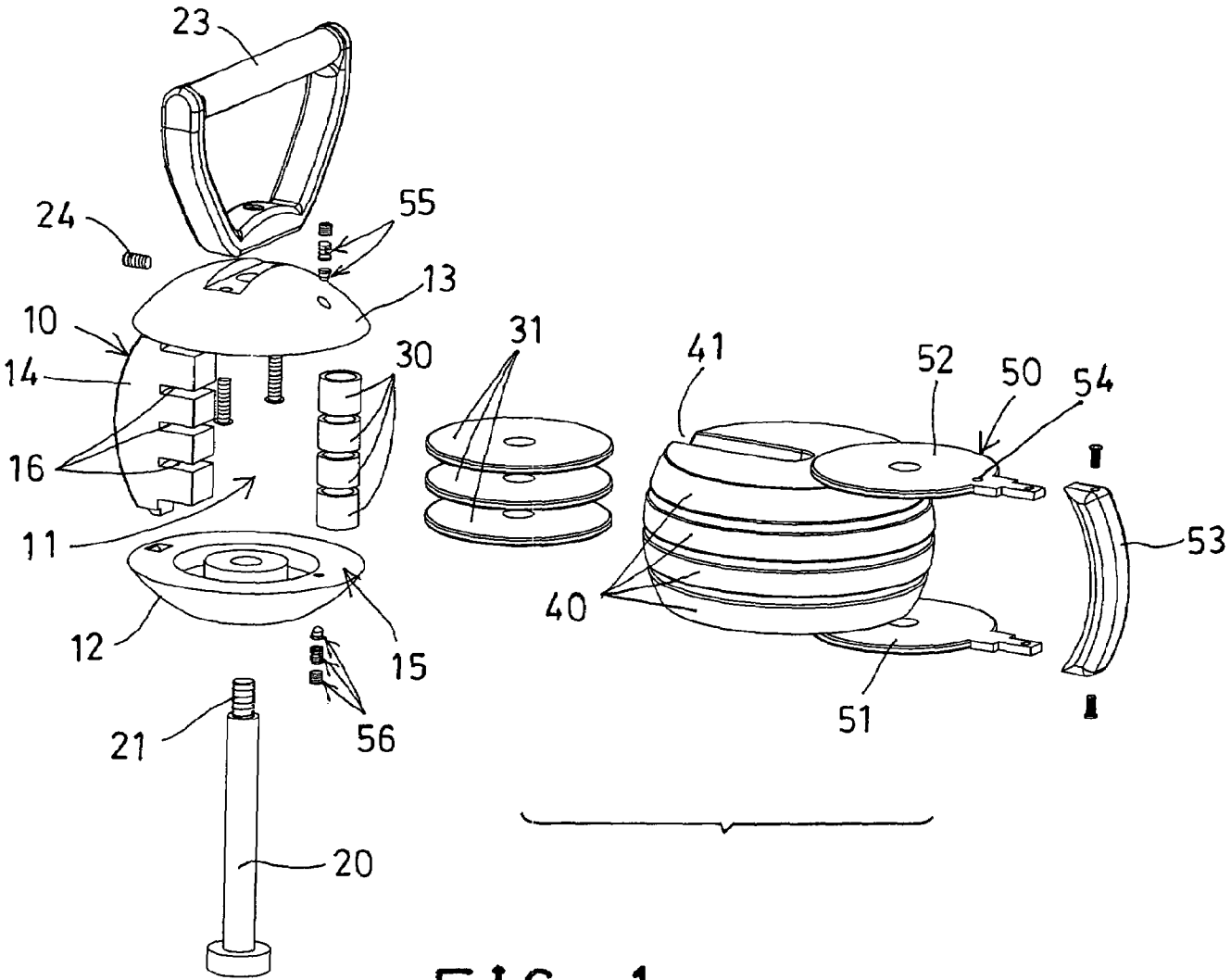
FIG. 1 is a partial exploded view of an adjustable kettlebell in accordance with the present invention.
Figure 3:
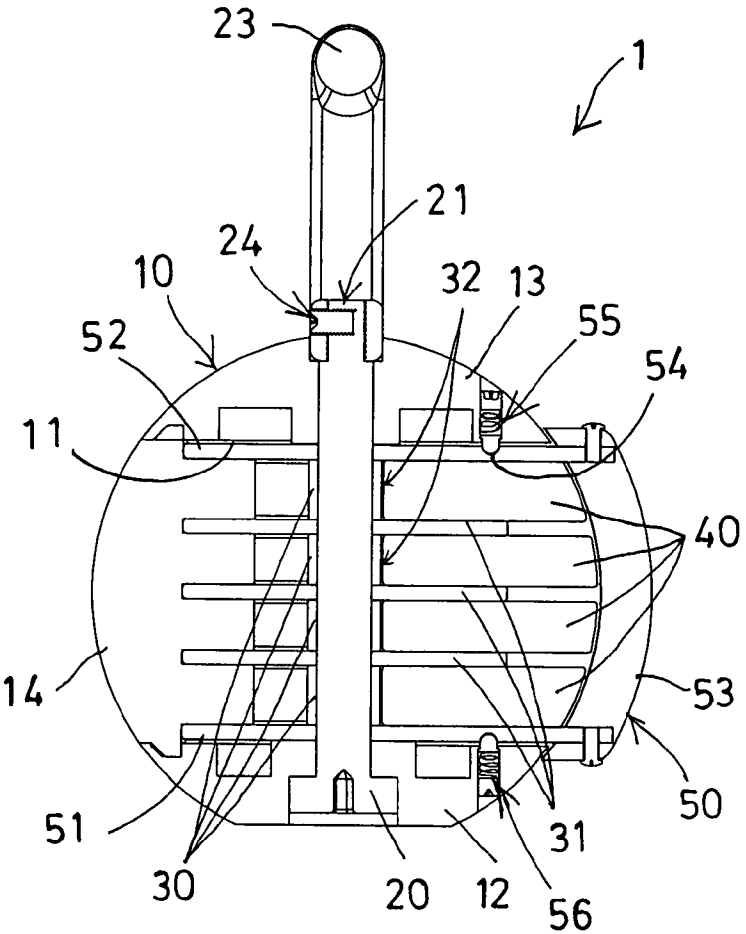
FIG. 3 is a partial cross sectional view of the adjustable kettlebell taken along lines 3-3 of FIG. 2.
Figure 2:
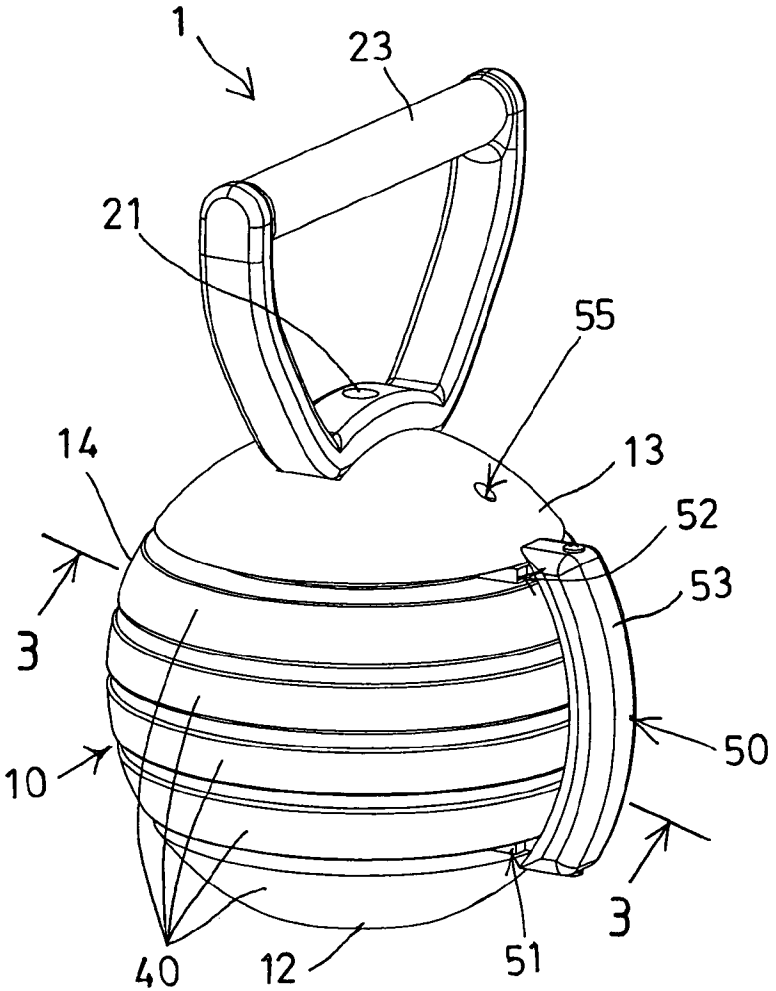
FIG. 2 is a perspective view of the adjustable kettlebell.
Figure 4:
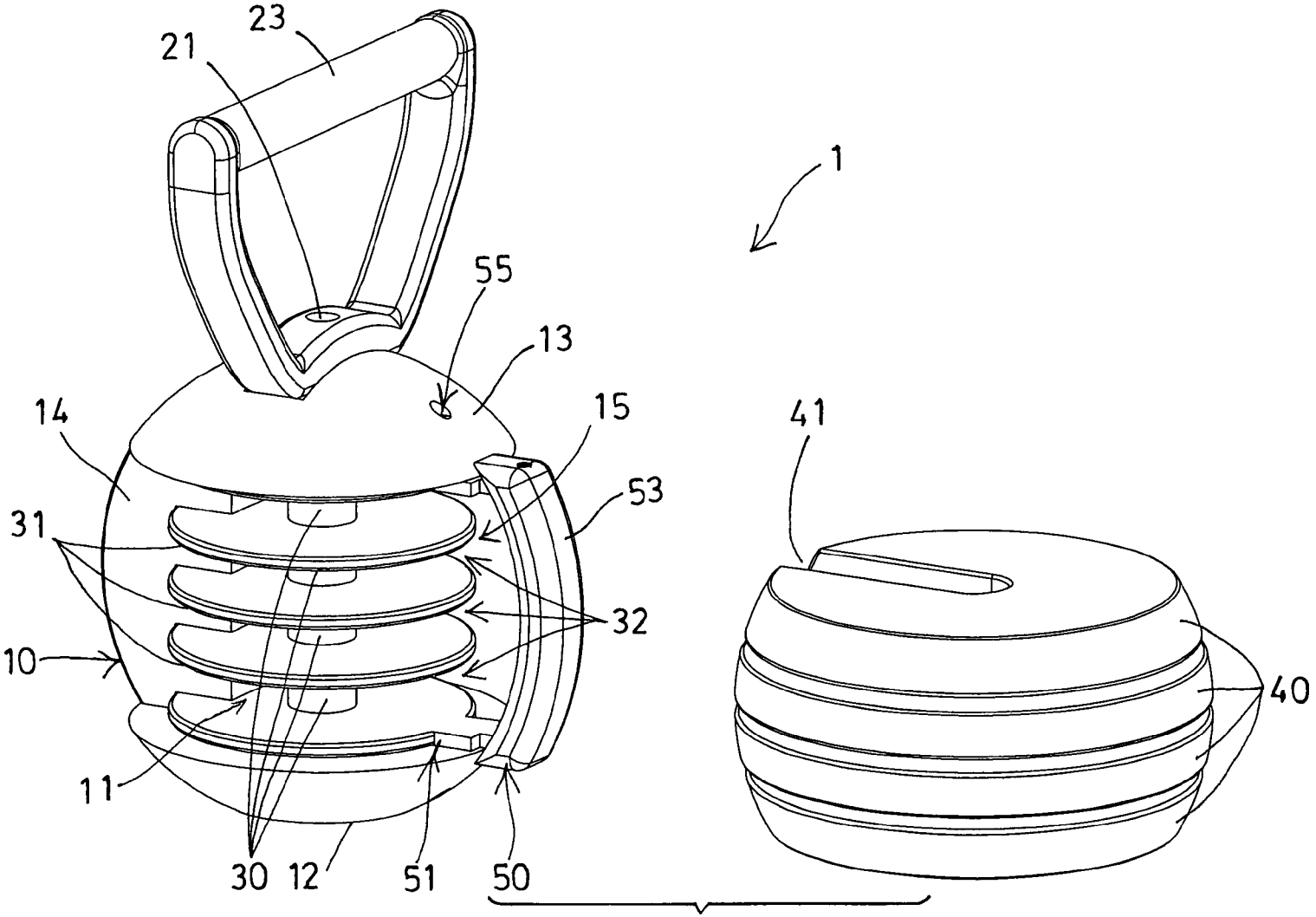
FIG. 4 is another partial exploded view of the adjustable kettlebell.

Referring to the drawings, and initially to FIGS. 1-4, an adjustable kettlebell 1 in accordance with the present invention comprises a housing or carrier 10 including a chamber 11 formed therein, and formed or defined by a base plate 12, an upper plate 13, and a side coupler 14 secured or coupled between the base plate 12 and the upper plate 13, and including an opening 15 formed in the carrier 10, and formed or defined between the base plate 12 and the upper plate 13 and communicating with the chamber 11 of the carrier 10.

A central shaft 20 is vertically disposed between the base plate 12 and the upper plate 13 of the carrier 10, and secured to the carrier 10 with one end or threaded fastener 21 for allowing the shaft 20 to be vertically extended through the chamber 11 of the carrier 10. A handle 23 is attached or secured to the carrier 10, such as secured to the upper plate 13 of the carrier 10 with the fastener 21 for carrying or lifting or moving the carrier 10 and for allowing the adjustable kettlebell 1 to be easily operated by the users. One or more further fasteners 24 may be provided and engaged with the handle 23 and the one end fastener 21 for solidly securing the handle 23 to the carrier 10.

Figure 5:
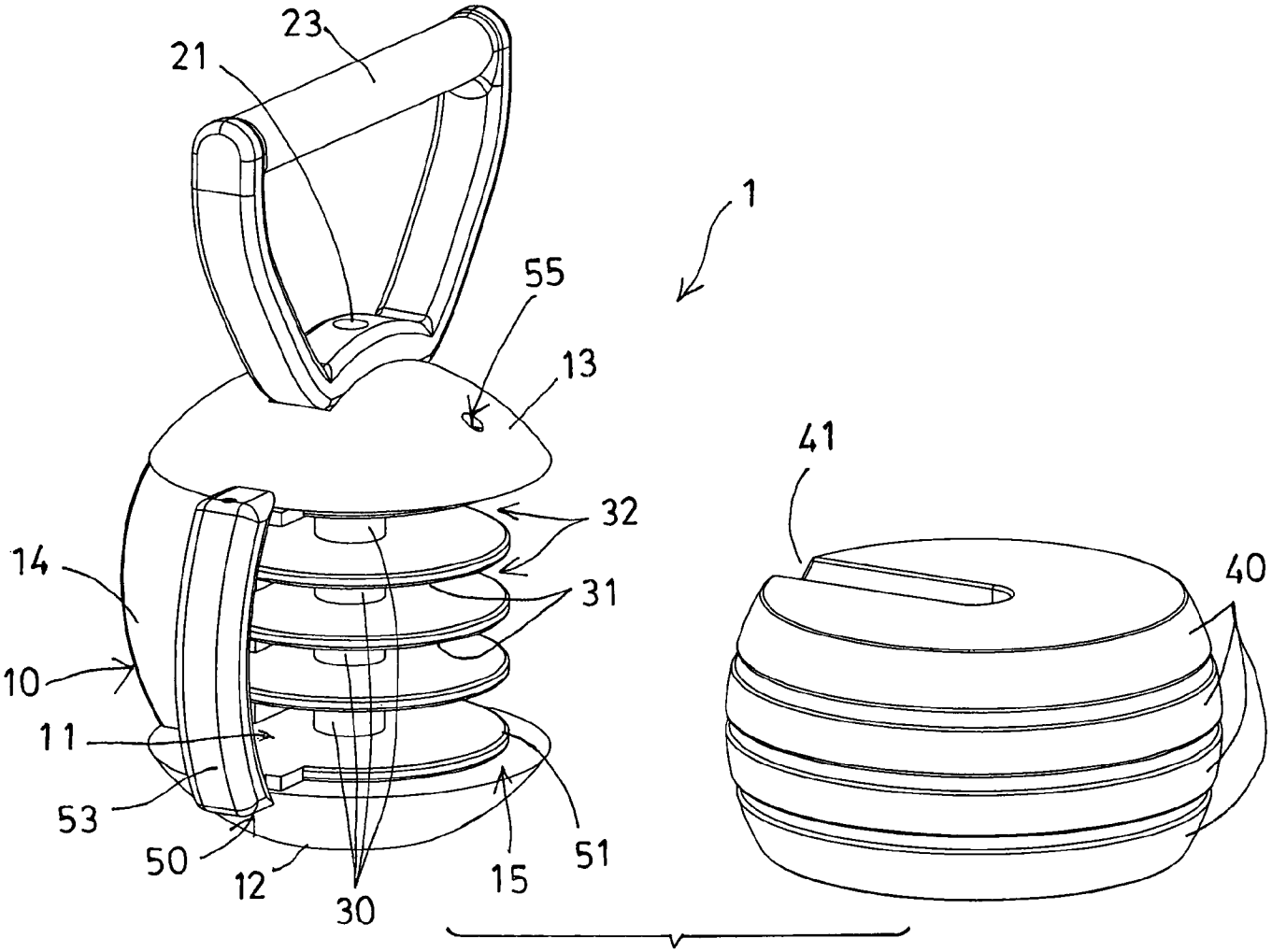
FIGS. 5, 6, 7 are partial exploded views similar to FIG. 4, illustrating the operation of the adjustable kettlebell.
Figure 6:
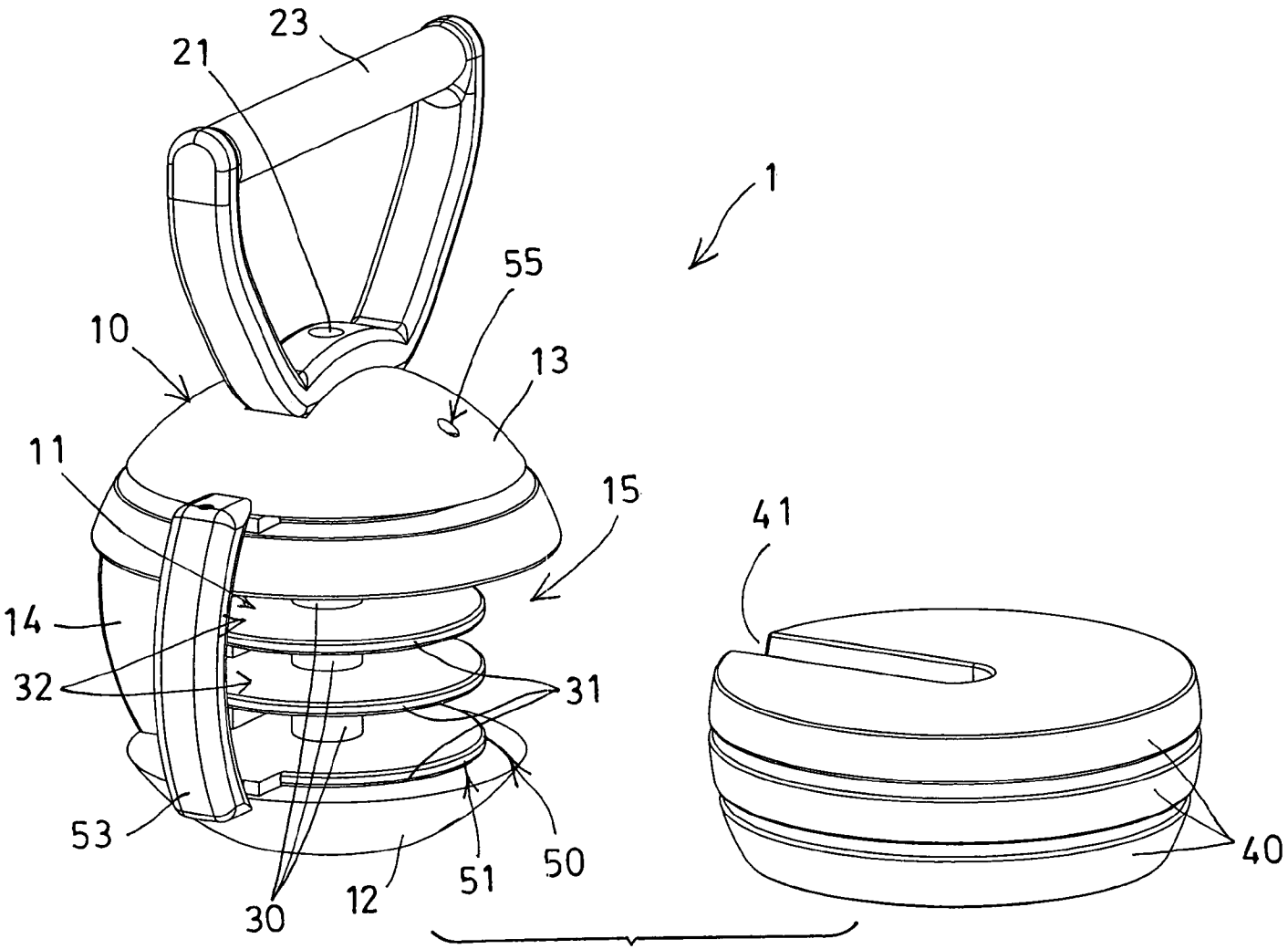

One or more washers or spacers 30 are attached or engaged onto the shaft 20, and one or more spacing or supporting rings or members 31 are also attached or engaged onto the shaft 20 and disposed or engaged between the spacers 30 for forming one or more spacing compartments 32 between the supporting members 31 and/or in the carrier 10, as best shown in FIGS. 3-6, and for detachably receiving or accommodating and retaining the weight plates or weight members 40. The side coupler 14 may include one or more channels 16 for receiving the supporting members 31 and for solidly anchoring or securing the supporting members 31 to the carrier 10.

For example, the weight members 40 each include a substantially U-shaped structure having a slot 41 formed therein for receiving the spacers 30 and/or the central shaft 20, and for allowing the weight members 40 to be easily and quickly attached to or disengaged from the central shaft 20 and/or the spacing compartments 32 of the carrier 10 without disengaging or disassembling the shaft 20 from the base plate 12 and the upper plate 13 of the carrier 10.

It is to be noted that the side coupler 14 of the carrier 10 may be partially engaged into the slots 41 of the weight members 40, or the slots 41 of the weight members 40 may partially receive or engage with the side coupler 14 of the carrier 10 for stably anchoring or positioning the weight members 40 to the carrier 10 and for preventing the weight members 40 from rotating relative to the carrier 10 and for preventing the weight members 40 from moved sidewise or laterally relative to the carrier 10.

A retaining device 50 is rotatably attached or secured to the carrier 10, for example, the retaining device 50 includes two panels 51, 52, such as a lower panel 51 and an upper panel 52 rotatably attached or secured to the shaft 20 of the carrier 10, and preferably engaged with the base plate 12 and the upper plate 13 of the carrier 10 respectively, and includes a handgrip or retainer 53 secured or coupled between the lower panel 51 and the upper panel 52 and rotatable relative to the carrier 10.

Figure 7:
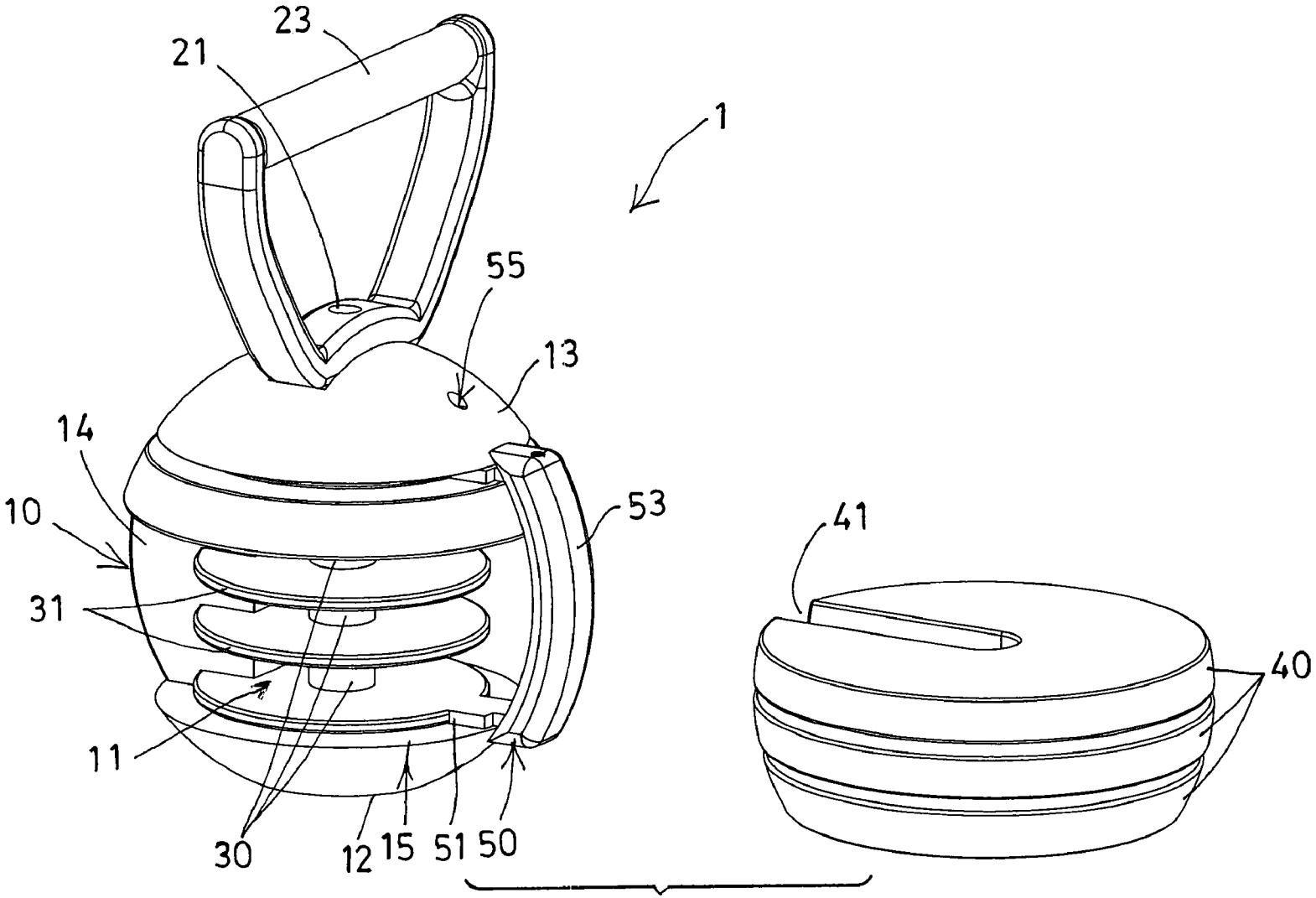

In operation, as shown in FIGS. 2-7, the retainer 53 of the retaining device 50 may be rotated relative to the carrier 10 to the side portion of the carrier 10 and/or to open the opening 15 of the carrier 10 (FIGS. 5, 6), and to allow one or more of the weight members 40 to be selectively or changeably attached to the shaft 20 and/or the spacing compartments 32 of the carrier 10, and to allow one or more of the weight members 40 to be selectively or changeably received and retained within the chamber 11 and/or the spacing compartments 32 of the carrier 10.

After the required number of the weight members 40 have been attached to the shaft 20 and/or the spacing compartments 32 of the carrier 10, the retainer 53 of the retaining device 50 may be rotated relative to the carrier 10 again to partially close the opening 15 of the carrier 10 (FIGS. 2-4, 7), or to a position opposite to the side coupler 14, and to engage with the weight members 40 that have been attached to the shaft 20 and/or the spacing compartments 32 of the carrier 10, and to stably retain the weight members 40 to the carrier 10, and to allow the weight members 40 to be changeably and easily and quickly attached to the carrier 10.

The retaining device 50 may further include one or more depressions 54 formed therein, such as formed in the upper panel 52 of the retaining device 50 (FIGS. 1, 3), and a spring-biased projection 55 is engaged into the carrier 10, such as engaged into the upper plate 13 of the carrier 10 (FIG. 3) and partially extended out of the upper plate 13 of the carrier 10 and engageable with the depression 54 of the upper panel 52 of the retaining device 50 for anchoring or positioning or retaining the retaining device 50 to the carrier 10 at the required position.

For example, the spring-biased projection 55 may be disengaged from the depression 54 of the retaining device 50 when the retainer 53 of the retaining device 50 is rotated relative to the carrier 10 toward the side coupler 14 or the side portion of the carrier 10 and/or to open the opening 15 of the carrier 10 (FIGS. 5, 6), and to allow one or more of the weight members 40 to be selectively or changeably attached to the shaft 20 and/or the spacing compartments 32 of the carrier 10.

On the contrary, when the spring-biased projection 55 is engaged with the depression 54 of the retaining device 50, the retainer 53 of the retaining device 50 may be rotated relative to the carrier 10 to the position where the retainer 53 partially closes the opening 15 of the carrier 10 (FIGS. 2-4, 7), and to engage with the weight members 40 and to retain the selected number of weight members 40 in the chamber 11 of the carrier 10, and to allow the user to easily operate the adjustable kettlebell 1 with different number of weight members 40.

It is to be noted that the retainer 53 of the retaining device 50 may be easily and quickly rotated relative to the carrier 10 to close the opening 15 of the carrier 10 and to engage with the weight members 40 and to stably retain the selected number of weight members 40 in the chamber 11 of the carrier 10 selectively or to engage with the side coupler 14 of the carrier 10 and/or to open the opening 15 of the carrier 10 and to allow one or more of the weight members 40 to be selectively or changeably attached to the shaft 20 and/or the spacing compartments 32 of the carrier 10 without disengaging or disassembling the shaft 20 from the base plate 12 and the upper plate 13 of the carrier 10.

Another spring-biased projection 56 may further be provided and engaged into the carrier 10, such as engaged into the lower plate 12 of the carrier 10 (FIGS. 1, 3) and partially extended out of the lower plate 12 of the carrier 10 and engageable with the lower panel 51 of the retaining device 50 for further anchoring or positioning or retaining the retaining device 50 to the carrier 10 at the required position, particularly when the retainer 53 of the retaining device 50 is rotated relative to the carrier 10 to the position where the retainer 53 partially closes the opening 15 of the carrier 10 and to solidly retain the weight members 40 within the chamber 11 of the carrier 10.

Accordingly, the adjustable kettlebell in accordance with the present invention includes an improved structure for allowing the weight members to be easily attached to or disengaged from the weight carrier and for allowing the adjustable kettlebell to be easily operated.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable kettlebell comprising:

a carrier including a chamber formed therein, and including an opening formed in said carrier and communicating with said chamber of said carrier, and including a first compartment and at least one second compartment formed in said carrier and communicating with said chamber of said carrier, a handle attached to said carrier for carrying said carrier, a first weight member and at least one second weight member selectively engaged into said first and said at least one second compartment of said carrier from said opening of said carrier, and a retaining device rotatably attached to said carrier for selectively opening said opening of said carrier and for allowing said first and said at least one second weight members to be selectively engaged into said carrier, and for selectively closing said opening of said carrier in order to selectively retain either or both of said first and said at least one second weight members to said carrier.

2. The adjustable kettlebell as claimed in claim 1, wherein said carrier includes a base plate, an upper plate, and a side coupler coupled between said base plate and said upper plate for forming said opening of said carrier.

3. The adjustable kettlebell as claimed in claim 2, wherein said carrier includes a shaft disposed between said base plate and said upper plate, and at least one supporting member attached to said shaft for forming said first and said at least one second compartment in said carrier.

4. The adjustable kettlebell as claimed in claim 3, wherein said carrier includes at least one spacer attached to said shaft and engaged with said at least one supporting member.

5. The adjustable kettlebell as claimed in claim 3, wherein said first and said at least one second weight members each include a slot formed therein for receiving said shaft.

6. The adjustable kettlebell as claimed in claim 5, wherein said slots of said first and said at least one second weight members are engaged with said side coupler of said carrier for anchoring said first and said at least one second weight members to said carrier and for preventing said first and said at least one second weight members from rotating and moving relative to said carrier.

7. The adjustable kettlebell as claimed in claim 3, wherein said retaining device includes a retainer rotatably attached to said carrier for selectively opening or closing said opening of said carrier.

8. The adjustable kettlebell as claimed in claim 7, wherein said retaining device includes at least one panel rotatably attached to said shaft of said carrier, and said retainer is secured to said at least one panel.

9. The adjustable kettlebell as claimed in claim 1, wherein said carrier includes a spring-biased projection engaged therein for engaging with said retaining device and for anchoring said retaining device to said carrier at a required position.

10. The adjustable kettlebell as claimed in claim 9, wherein said retaining device includes at least one depression formed therein for engaging with said spring-biased projection.

* * * * *